United States Patent [19]

Hooper

[11] 4,188,030

[45] Feb. 12, 1980

[54] CYCLE EXERCISER

[75] Inventor: Lindsay A. Hooper, Belgrave, Australia

[73] Assignee: Repco Limited, Melbourne, Australia

[21] Appl. No.: 828,737

[22] Filed: Aug. 29, 1977

[30] Foreign Application Priority Data

Oct. 18, 1976 [AU] Australia ..... PC7758

[51] Int. Cl.[2] ..... A63B 21/00

[52] U.S. Cl. ..... 272/73; 272/130

[58] Field of Search ..... 272/73, 72, 71, 116, 272/131, 132, 134, 143, 130; 128/25 R, 25 B

[56] References Cited

U.S. PATENT DOCUMENTS

| | | | |
|---|---|---|---|
| 326,247 | 9/1885 | Root | 272/71 |
| 2,032,303 | 2/1936 | Orgitano | 128/25 R |
| 2,261,355 | 11/1941 | Flynn | 128/25 R |
| 2,453,771 | 11/1948 | White et al. | 128/25 R |
| 2,565,348 | 8/1951 | Brockman et al. | 128/25 R |
| 2,872,191 | 2/1959 | Gallo, Sr. | 272/73 |
| 3,112,108 | 11/1963 | Hanke | 272/72 X |
| 3,758,111 | 9/1973 | Agamian | 272/73 |
| 3,940,128 | 2/1976 | Ragone | 272/73 |
| 3,979,113 | 9/1976 | Uhl et al. | 272/73 |

FOREIGN PATENT DOCUMENTS

| | | | |
|---|---|---|---|
| 994823 | 8/1976 | Canada | 272/73 |
| 517774 | 2/1931 | Fed. Rep. of Germany | 272/73 |
| 779363 | 1/1935 | France | 272/73 |
| 1194046 | 6/1970 | United Kingdom | 272/73 |

*Primary Examiner*—Richard C. Pinkham
*Assistant Examiner*—Arnold W. Kramer
*Attorney, Agent, or Firm*—Stevens, Davis, Miller & Mosher

[57] ABSTRACT

A cycle exerciser having a vaned wheel rotatably mounted on a frame and arranged to absorb energy by movement of the broad surfaces of the vanes against the surrounding body of air. Rotation of the wheel is effected through a pair of foot pedals and connected chain and sprocket mechanism, and/or through a pair of handle bars. Each handle bar is pivotally connected to the frame and is also connected to a respective eccentric through a crank ring rotatably mounted on that eccentric and a drive bar connected to both the crank ring and the handle bar. The two eccentrics are arranged 180° out of phase and are connected to the foot pedal assembly so as to rotate in response to both pivotal movement of the handle bars and operation of the foot pedals. As the eccentrics are drivably connected to the vaned wheel, that wheel is caused to rotate in response to rotation of the eccentrics.

16 Claims, 8 Drawing Figures

CYCLE EXERCISER

This invention relates to cycle exercisers, and is particularly although not exclusively applicable to a ergometer-exerciser of the kind disclosed in Australian Pat. No. 462,920.

Cycle exercisers suffer a disadvantage in that they only make use of the muscles of the legs and lower torso of the user. Exercises such as jogging and running are usually considered to be of more benefit because more muscle groups are brought into play, thereby placing a greater cumulative demand on the oxygen transport system of the body.

It is a particular object of the present invention to provide a cycle-type exerciser which is adapted to permit muscle groups in the upper part of the body to be used in the course of operation of the exerciser.

According to the present invention there is provided a cycle exerciser including, a frame, energy absorbing means rotatably mounted on said frame, foot operated means drivably connected to said energy absorbing means for causing rotation thereof, and a handle bar assembly mounted on said frame for movement relative thereto and being drivably connected to said energy absorbing means in a manner such that movement of said handle bar assembly relative to said frame causes rotation of said energy absorbing means.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
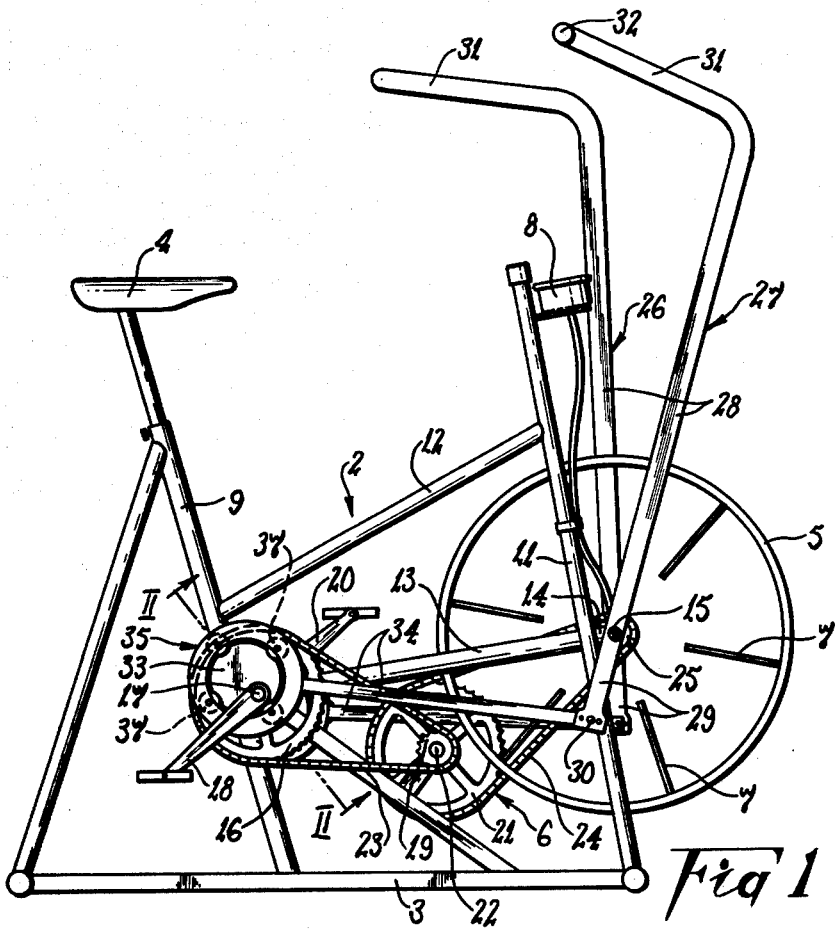
FIG. 1 is a side elevational view of an example cycle exerciser incorporating the present invention.

As a matter of convenience, the invention will be hereinafter described as applied to a cycle exerciser of the kind disclosed in Australian Pat. No. 462,920. That exerciser includes a frame 2 having a base section 3 for supporting the exerciser on a floor or other surface, and which frame 2 carries a seat 4 at a rear end and a rotatable energy absorbing wheel 5 at the front end. The wheel 5 is driven by a pedal actuated chain and sprocket drive assembly 6, and resistance to wheel movement is achieved through blades or vanes 7 secured around the periphery of the wheel 5. A direct reading work output meter 8 is commonly associated with such exerciser. The ergometric effect of that form of exerciser and its manner of calibration for accurate measurement of work output, is fully described in the aforementioned Australian Pat. No. 462,920.

In the above example exerciser, and other conventional cycle exercisers, rigidly mounted handle bars are provided for the user to grip and react his body against in driving the wheel 5 through the foot pedal drive assembly. It is a feature of the present invention that the handle bars are movably mounted on the frame and are drivably connected to the wheel so that rotation of the wheel can be achieved either through leg movement or arm movement, or both.

A typical frame 2 of a cycle exerciser is shown in FIG. 1, and includes a seat supporting column 9 extending upwardly from the rear end portion of the base 3, and a pair of laterally spaced members 11 (one only is visible in FIG. 1) extending upwardly from a front end portion of the base 3. In a conventional construction, the front upright members 11 support the rigid handle bars at their upper ends, or are extended at their upper ends to form those bars. In the present case however, the handle bars are connected in a different manner as hereinafter described. At least one bracing member 12 connects the upper section of the front members 11 to the seat supporting column 9. A wheel mounting is provided by two longitudinally extending frame members 13 (only one is visible in FIG. 1) which are each connected to a respective one of the front upright members 11 and projects forwardly beyond that member. The two forward projections 14 define laterally spaced forks adapted to receive the wheel axle 15 in a conventional manner, and the rearward end of each longitudinal member 13 is connected to the seat supporting column 9.

The invention will be hereinafter described in relation to the particular frame described above, but it is not limited to that frame. Similar comments apply to the drive mechanism described in the following passages of this specification.

Drive mechanism 6 for the wheel 5 normally comprises a chain and sprocket assembly actuated by a conventional foot pedal crank arrangement. A typical mechanism of that kind used in cycle exercisers is shown in FIG. 1, and includes a primary sprocket 16 connected to the main drive shaft 17 which is rotatably mounted on the frame 2, preferably on the seat supporting column 9 near the junction of the longitudinal frame members 13, and has a respective pedal crank arm 18 and 20 secured to each of its ends. A secondary sprocket assembly is rotatably mounted on the frame 2 between the seat supporting column 9 and the front upright members 11, and includes two sprockets 19 and 21 of different diameter interconnected through a secondary shaft 22. The primary sprocket 16 is connected to the smaller secondary sprocket 19 through one chain 23, and another chain 24 connects the larger secondary sprocket 21 to a sprocket 25 secured to the wheel axle 15.

Figure 7:
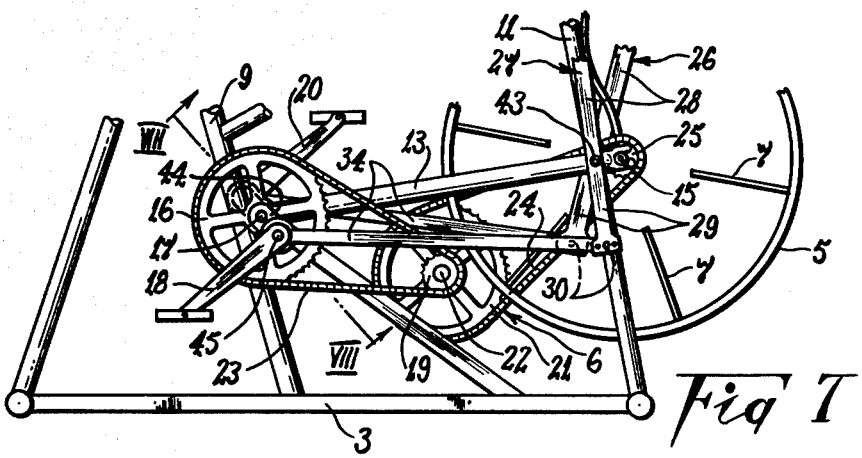
FIG. 7 is a side elevational view of part only of the exerciser according to an alternative embodiment.

In the particular construction shown in the drawings, the handle bar assembly comprises two separate handle bars, 26 and 27. Each handle bar 26 and 27 includes an elongate lever 28 which is pivotally connected to the frame 2 and arranged so as to extend generally upright. The pivot connection may be formed by extensions of the wheel axle 15 so that each lever 28 is connected to a respective opposite end of that axle as shown in FIG. 1. It will be appreciated however, that other forms of pivotal mounting may be employed, such as a pivotal connection direct to the front upright members 11 of the frame 2 as shown in FIG. 7. A relatively short section 29 of each lever 28 projects below the pivotal mounting whereas a relatively long section projects above, so as to provide a suitable mechanical advantage for the user in operating the exerciser as hereinafter described. The short section 29 is not essential and may be omitted if desired so that the drive connection hereinafter described will then be connected to the lever 28 above the pivot 15 rather than below it as shown in the drawings. The upper end portion 31 of each lever 28 is bent to extend rearwardly for convenient engagement by the user, and a laterally projecting hand grip 32 may be provided at the terminal end of each rearwardly extending portion 31. Quite clearly, the actual form and arrangement of each handle bar can vary considerably, according to requirements.

A drive connection is provided between the two handle bars 26 and 27, and the wheel 5, and in the preferred form shown that connection includes the drive mechanism 6. In that form, each handle bar 26 and 27 is operatively connected to the drive mechanism 6 through a respective transmission system. Preferably, as shown, each such system includes an eccentric 33 which rotates with the main drive shaft 17 and is connected to a drive bar 34. The connection 30 between the lever 28 and drive bar 34 is a pivotable one, and may be adjustable to permit variation of its position relative to the pivotal axis of the lever 28 and/or to permit variation of the effective length of the drive bar 34.

Figure 2:
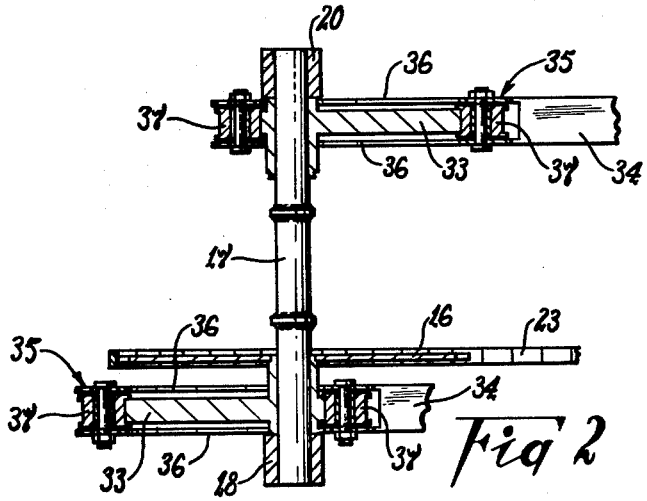
FIG. 2 is an enlarged cross-sectional view taken along line II—II of FIG. 1.

In the example arrangement best shown in FIG. 2, each eccentric 33 comprises a disc secured to the main drive shaft 17 in non-concentric relationship, so as to rotate therewith. Connection between the eccentric disc 33 and the associated drive bar 34 is achieved by way of a crank ring 35 rotatably mounted on the disc 33 and secured to the drive bar 34. The crank ring 35 is preferably formed by two laterally spaced annular plates 36 having a plurality of rollers 37 mounted between them and arranged for rolling engagement about the outer periphery of the eccentric disc 33. Each plate 36 is secured to the associated drive bar 34 in any appropriate fashion. It will be appreciated that numerous other constructions are available for achieving the necessary rotational relationship between the eccentric 33 and the adjacent end of the drive bar 34. Furthermore, the eccentric 33 need not comprise a disc as described, but could be of any other form such as an eccentrically located pin.

The arrangement described above is such that movement of either handle bar 26 or 27 about is pivotal mounting 15, tends to pull the associated drive bar 34 away from the main drive shaft 17, or to push it towards that shaft, depending on the direction of handle bar movement. Assuming that the drive bar 34 is disposed so that its line of action is to one side of the main drive shaft axis, a turning moment will be applied to the eccentric disc 33 and the main drive shaft 17 is thereby rotated. The aforementioned line of action is an imaginary straight line joining the rotational axis of the crank ring 35 and the axis of the pivotal connection 30 between the drive bar 34 and handle bar lever 28.

Figure 3:
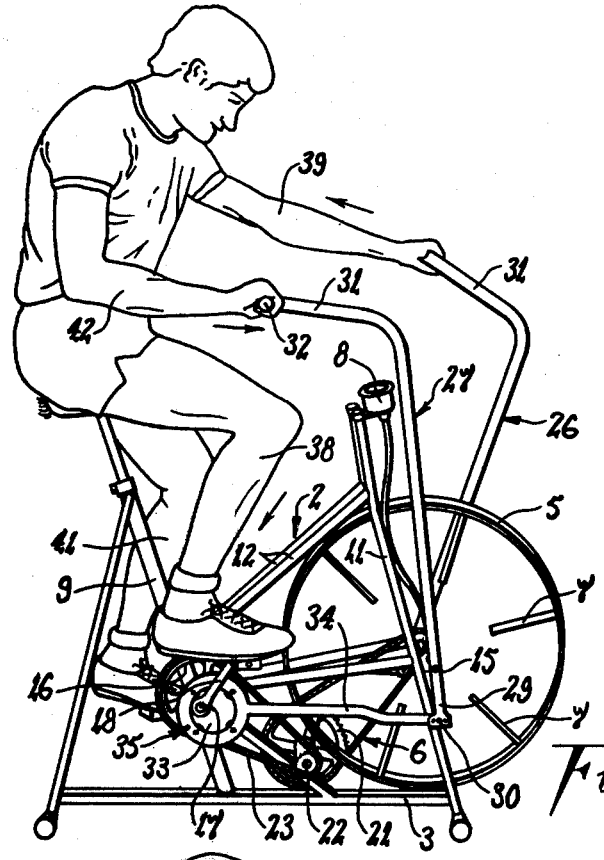
FIG. 3 is a view similar to FIG. 1 but showing the cycle exerciser in operation.
Figure 4:
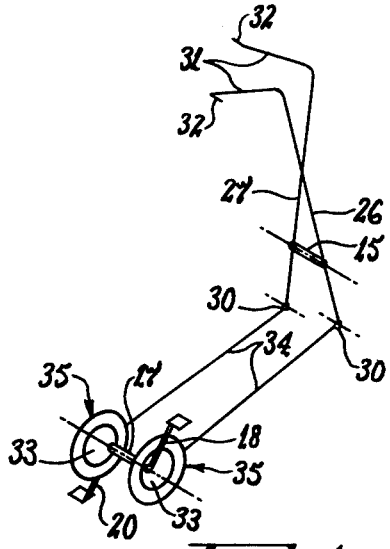
FIG. 4 is a diagrammatic view showing the relative disposition of principal components in the situation depicted in FIG. 3.
Figure 5:
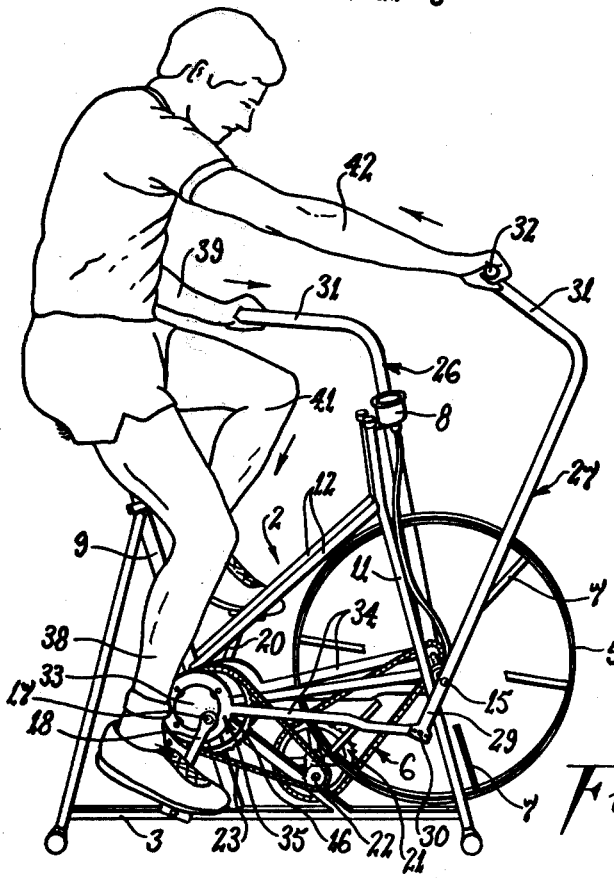
FIG. 5 is a view similar to FIG. 3 but showing the exerciser at a different stage of operation.
Figure 6:
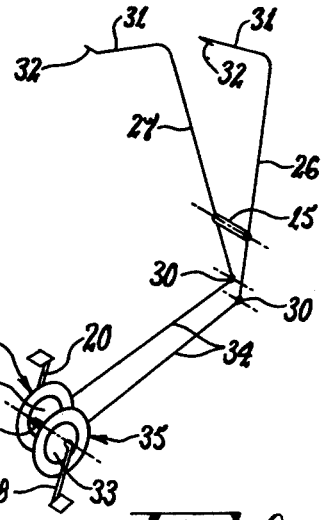
FIG. 6 is a view similar to FIG. 4 but relative to the FIG. 5 situation.

Preferably, as shown in the drawings, the two eccentrics 33 are arranged 180° out of phase—i.e., in a manner similar to the foot pedal cranks 18 and 20. It is also preferred that the eccentrics 33 are positioned relative to the pedal crank 18 and 20 so as to achieve a natural balance between upper and lower body movements in a manner similar to walking and running. That is, when the right leg 38 of the user is pushing downwards, as shown in FIG. 3 the left arm 39 and shoulder are moving backwards. As seen in FIG. 5 however, when the left leg 41 is pushing downwards, the right arm 42 and shoulder are moving backwards. FIGS. 4 and 6 show, in diagrammatic form, the relative positions of the major components in the FIGS. 3 and 5 situations respectively.

Figure 8:
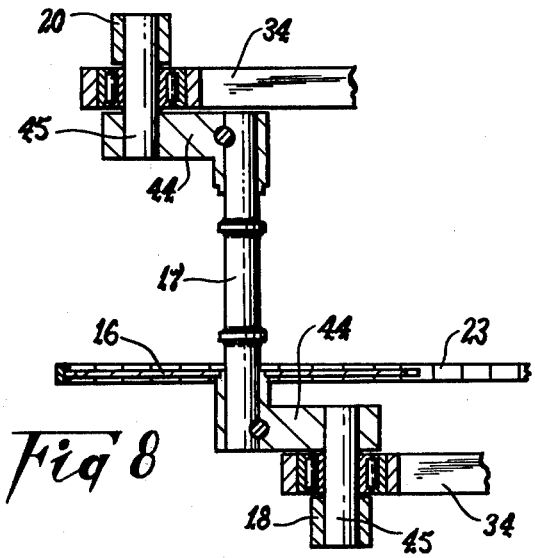
FIG. 8 is a part sectional view, on an enlarged scale, taken along line VIII—VIII of FIG. 7.

In the alternative construction shown in FIGS. 7 and 8, the levers 28 are pivotally connected direct to the frame upright members 11 as at 43, rather than through the wheel axle 15, and the eccentric of the drive connection is different to that shown in FIG. 2. The alternative eccentric, for each drive bar 34, includes a crank arm 44 which is connected to the respective end of the drive shaft 17 so as to rotate with that shaft, and the two arms 44 extend laterally from the shaft 17 in opposite directions. A crank pin 45 having its axis substantially parallel to that of the shaft 17, extends from the outer end of each arm 44 and provides a connection for the drive bar 34 and pedal crank arm 18 or 20. Each drive bar 34 is rotatably mounted on its respective crank pin 45, but the pedal crank arms 18 and 20 are secured to their pins 45 against relative rotation. It will be appreciated that such a construction permits rotation of the shaft 17 by foot and/or hand actuation as in the construction previously described.

The user of an exerciser as described can proportion the ratio of effort contributed by the arms and legs dependant on the degree of fatigue found in either, but the total result of using the exerciser is that a greater number of muscle groups can be exercised than is possible by use of conventional cycle exercisers.

It will be understood that various alterations, modifications, and/or additions may be incorporated into the foregoing without departing from the scope of the invention as defined by the appended claims.

Having now described my invention, what I claim as new and desire to secure by Letters Patent is:

1. A cycle exerciser including; a frame; a seat mounted on said frame; energy absorbing means rotatably mounted on said frame; a substantially horizontal drive shaft having two ends rotatably carried by said frame; first drive means connecting said drive shaft to said energy absorbing means to cause rotation thereof in response to rotation of said drive shaft; a drive crank arm secured to each of two opposite end portions of said drive shaft and extending laterally therefrom in opposite directions; two foot pedal crank arms; connecting means through which each said foot pedal crank arm is fixedly secured to the outer end of a respective said drive crank arm to permit rotation of said drive shaft by foot operation; two handlebar levers mounted on said frame for oscillatory movement; and second drive means connecting the outer end of each said drive crank arm to a respective one of said handlebar levers so that said drive shaft is caused to rotate in response to said oscillation of the handlebar levers; said second drive means being connected to said connecting means so as to be interposed between the outer end of each said drive crank arm and the adjacent end of the respective foot pedal crank arm.

2. A cycle exerciser including; a frame; a seat mounted on said frame; energy absorbing means rotatably mounted on said frame; a substantially horizontal drive shaft rotatably mounted on said frame so that end portions thereof project outwardly from opposite sides of said frame; drive means connecting said drive shaft to said energy absorbing means to cause rotation thereof in response to rotation of said drive shaft; two handlebar levers mounted on said frame for oscillatory movement; a handlebar drive connection secured to each said drive shaft end portion for rotation with said drive shaft; a drive bar forming at least part of an operative connection between each said drive connection and a respective one of said handlebar levers so that said drive shaft is caused to rotate in response to oscillation of the handlebar levers; two foot pedal crank arms, each of which is connected to a respective said drive shaft end portion to permit rotation of said drive shaft by foot operation and is located outwardly of the handlebar drive connection at that end portion; each said handlebar drive connection including a drive crank arm secured to the respective said shaft end portion to extend laterally therefrom, and a crank pin secured to the outer end of the drive crank arm and having its axis substantially parallel to the axis of said drive shaft, said drive crank arms extending from said shaft in opposite directions; each said foot pedal crank arm is secured to a respective said crank pin so that the two foot pedal crank arms extend in opposite directions; and each said drive bar has an end portion journalled on a respective said crank pin so as to be interposed between the outer end of the respective said drive crank arm and the adjacent end of the respective said foot pedal crank arm.

3. A cycle exerciser including; a frame a seat mounted on said frame; energy absorbing means rotatably mounted on said frame; a substantially horizontal drive shaft rotatably carried by said frame at a location below and forward of said seat; drive means connecting said drive shaft to said energy absorbing means to cause rotation thereof in response to rotation of said drive shaft; a drive crank arm secured to each of two opposite end portions of said drive shaft and extending laterally therefrom in opposite directions; a foot pedal crank arm fixedly secured to the outer end of each said drive crank arm to permit rotation of said drive shaft by foot operation; two handlebar levers located forward of said drive shaft; a pivotal mounting connecting each said handlebar lever to said frame for back and forth oscillatory movement, and at least part of each said lever extending upwardly from said pivotal mounting; two drive bars, each of which connects the outer end of a respective one of said drive crank arms to a respective one of said handle bar levers so that said drive shaft is caused to rotate in response to said oscillation of the handlebar levers; one end of each said drive bar being pivotally mounted on a connection between the respective said drive and foot pedal crank arms so that said end is interposed between adjacent ends of said crank arms, and the other end of each said drive bar is connected to the respective said handlebar lever through a pivotal connection which is spaced from said pivotal mounting in substantially the same direction as the corresponding pivotal connection of the other said drive bar; the arrangement being such that the upper end of one said handlebar lever is at a forwardmost position about its pivot axis when the upper end of the other handlebar lever is at a rearmost position.

4. A cycle exerciser according to claim 1, wherein a short section of each said handlebar lever extends below said pivotal mounting, and each said pivotal connection is adjacent a lower end of a respective said short section.

5. A cycle exerciser according to claim 1, wherein each said foot pedal crank arm is secured to its respective said drive crank arm through a crank pin extending laterally from said drive crank arm at a location spaced from said drive shaft and having its axis substantially parallel to the axis of said drive shaft, and each said drive bar has an end portion rotatably mounted on a respective one of said crank pins to form the said connection with said drive crank arm.

6. A cycle exerciser according to claim 1, wherein the two said foot pedal crank arms extend in substantially opposite directions, and each said foot pedal crank arm extends angularly relative to the drive crank arm to which it is secured so that when said foot pedal crank arm is moved downwards there is forward movement of the adjacent said handlebar lever.

7. A cycle exerciser according to claim 1, wherein said energy absorbing means is a wheel having a plurality of blades secured thereto and being arranged to resist rotation of said wheel by movement of their broad surfaces against the surrounding body of air.

8. A cycle exerciser according to claim 1, wherein a chain and sprocket mechanism drivably connects those crank arms to said energy absorbing means.

9. A cycle exerciser including; a frame; a seat mounted on said frame; energy absorbing means rotatably mounted on said frame; a substantially horizontal drive shaft rotatably carried by said frame; first drive means connecting said drive shaft to said energy absorbing means to cause rotation thereof in response to rotation of said drive shaft; an eccentric defining a disk fixed off center secured to each of two opposite end portions of said drive shaft for rotation therewith, said eccentrics being relatively arranged 180° out of phase, two handlebar levers mounted on said frame for oscillatory movement; second drive means connecting each said eccentric to a respective one of said handlebar levers so that said drive shaft is caused to rotate in response to said oscillation of the handlebar levers, each said second drive means having a collar portion journalled on a respective one of said eccentrics; and two foot pedal crank arms, each of which is secured to a respective opposite end portion of said drive shaft for rotation therewith and is located outwardly of the said eccentric at that end portion.

10. A cycle exerciser including; a frame; a seat mounted on said frame; energy absorbing means rotatably mounted on said frame; a substantially horizontal drive shaft rotatably mounted on said frame so that end portions thereof project outwardly from opposite sides of said frame; drive means connecting said drive shaft to said energy absorbing means to cause rotation thereof in response to rotation of said drive shaft; two handlebar levers mounted on said frame for oscillatory movement; a handlebar drive connection secured to each said drive shaft end portion for rotation with said drive shaft; a drive bar forming at least part of an operative connection between each said drive connection and a respective one of said handlebar levers so that said drive shaft is caused to rotate in response to oscillation of the handlebar levers; two foot pedal crank arms, each of which is connected to a respective said drive shaft end portion to permit rotation of said drive shaft by foot operation and is located outwardly of the handlebar drive connection at that end portion, and said foot pedal crank arms extending laterally relative to said drive shaft in opposite directions; and each said handlebar drive connection including an eccentric defining a disk fixed off center to said drive shaft for rotation therewith, each of which is arranged 180° out of phase with the other, and an end collar portion of the respective said drive bar which is journalled on said eccentric.

11. A cycle exerciser according to claim 9, wherein a short section of each said handlebar lever extends below said pivotal mounting, and each said pivotal connection is adjacent a lower end of a respective said short section.

12. A cycle exerciser according to claim 9, wherein said collar portion is rotatably mounted on each said eccentric.

13. A cycle exerciser according to claim 12, wherein each said collar portion includes a pair of annular plates, each of which is located on a respective opposite side of one eccentric disk, and a plurality of rollers secured between said plates and arranged in a circle about said eccentric disk so as to engage with the outer periphery of said eccentric disk.

14. A cycle exerciser according to claim 9, wherein the pivotal connection of said lever is coaxial with the axis of rotation of said energy absorbing means.

15. A cycle exerciser according to claim 9, wherein said energy absorbing means is a wheel having a plurality of blades secured thereto and being arranged to resist rotation of said wheel by movement of their broad surfaces against the surrounding body of air.

16. A cycle exerciser according to claim 9, wherein a chain and sprocket mechanism drivably connects those crank arms to said energy absorbing means.

* * * * *